US005722792A

United States Patent [19]

Morisseau

[11] Patent Number: 5,722,792

[45] Date of Patent: Mar. 3, 1998

[54] METHOD OF PUTTING A SALINE CAVITY UNDER GAS

[75] Inventor: Jean-Marc Morisseau, Marly-le-Roi, France

[73] Assignee: Societe Francaise de Stockage Geologique- Geostock, Rueil-Malmaison Cedex, France

[21] Appl. No.: 601,362

[22] Filed: Feb. 16, 1996

[30] Foreign Application Priority Data

Feb. 28, 1995 [FR] France ..... 95 02292

[51] Int. Cl.[6] ..... B65G 5/00

[52] U.S. Cl. ..... 405/59; 405/53

[58] Field of Search ..... 405/59, 55, 53, 405/52, 54; 166/266, 267

[56] References Cited

U.S. PATENT DOCUMENTS

| | | | |
|---|---|---|---|
| 2,057,248 | 10/1936 | Peyrouse | 405/59 X |
| 2,661,062 | 12/1953 | Edholm | 405/59 |
| 2,901,403 | 8/1959 | Adams et al. | 405/59 X |
| 2,994,200 | 8/1961 | Carpenter . | |
| 3,056,265 | 10/1962 | Swinney | 405/59 |
| 3,068,654 | 12/1962 | Warren | 405/55 |
| 3,068,884 | 12/1962 | Naul et al. | 405/59 X |
| 3,277,654 | 10/1966 | Shiver | 405/59 X |
| 3,355,893 | 12/1967 | Kuhne | 405/59 X |
| 3,459,002 | 8/1969 | Clamens | 405/59 |
| 3,608,636 | 9/1971 | Dixon | 405/55 X |
| 4,701,072 | 10/1987 | Berezoutzky | 405/59 X |
| 5,129,759 | 7/1992 | Bishop | 405/59 |
| 5,310,282 | 5/1994 | Vaskamp | 405/59 X |

FOREIGN PATENT DOCUMENTS

| | | |
|---|---|---|
| 1468258 | 12/1966 | France . |
| 1481767 | 4/1967 | France . |
| 1506216 | 11/1967 | France . |
| 1538684 | 7/1968 | France . |
| 2080955 | 2/1971 | France . |

OTHER PUBLICATIONS

Petrole et Techniques, vol. 2025, No. 258, Dec. 1978, pp. 45–52, J.P. Laporte 'le Stockage Souterrain:un Nouvel "Age des Cavernes".

Oil % Gas Journal, vol. 92, No. 50, Dec. 1994, Tulsa–Oklahoma, USA, pp. 35–42, XP 000487047 P.De Laguerie "French Gas–Storage Project Nearing Completion".

*Primary Examiner*—Dennis L. Taylor

*Attorney, Agent, or Firm*—Sughrue, Mion, Zinn, Macpeak & Seas, PLLC

[57] ABSTRACT

A method of putting under gas a saline cavity 3 for storing a gaseous substance, the cavity being formed by being washed out in rock salt and being filled with brine 5 once the washing-out step has been completed, the cavity includes a bottom 31 and a roof 30, a well 1 drilled for washing-out purposes opening out in the roof and putting the saline cavity into communication with the surface, the well also serving as an injection well for inserting the gaseous substance to be stored. The method includes a step of drilling an associated dewatering well 4 from the surface in the proximity of the injection well, the dewatering well meeting the saline cavity close to the bottom thereof so as to dewater the brine from the cavity through said dewatering well as the gaseous substance is injected into the cavity via the injection well.

7 Claims, 3 Drawing Sheets

PRIOR ART

PRIOR ART

METHOD OF PUTTING A SALINE CAVITY UNDER GAS

The present invention relates to a method of putting under gas a saline cavity for storing a gaseous substance such as natural gas, ethylene, ethane, or indeed compressed air. A saline cavity is formed in rock salt by washing out, which technique consists in establishing a flow of water to dissolve the salt.

BACKGROUND OF THE INVENTION

In conventional manner, when a site satisfying the conditions required for developing a saline storage cavity has been identified, a well is drilled into the rock salt. FIG. 1 is a vertical section through the well. The wall of the well 1 is provided with cemented casing 11 which is installed in definitive manner and which has its bottom end positioned above the level that is to be washed out. A dual washing-out column 12 comprising two generally concentric tubes is then lowered down the well to allow water to be injected and to recover the brine formed by the salt dissolving on contact with the water. Depending on the washing-out technique used, the water is either injected via the inner tube with the brine rising up the annular space constituted by the two concentric washing-out tubes, or vice versa. The annular space between the cemented casing and the outer washing-out tube is designed to receive a fluid, e.g. gas oil, that is inert relative to salt and that is referred to as a "guard". The guard serves to prevent uncontrolled dissolution of the salt in an upwards direction and to position the roof of the cavity at the desired level. The cavity expands laterally as the salt is dissolved by the injected water, with the insoluble blocks 20 contained in the rock salt 2 accumulating in the bottom of the cavity. Washing out is generally performed using the washing-out tubes in a plurality of different positions depending on the shape desired for the cavity and the characteristics of the rock salt. The washing-out stage is continued until the cavity has reached the required shape and volume or until it has reached a maximum size for given on-site conditions. The cavity must be developed in such a manner as to ensure that it is leakproof given the impermeability of salt, and also to ensure that it is stable.

Once the washing-out stage has been completed and the washing-out tubes have been removed, the cavity must be emptied of its brine so as to leave room for the gaseous substance that is to be stored therein. In a conventional technique that is well known in the prior art, the stage of withdrawing the brine known as "dewatering" consists in inserting a column down the well that has been used for washing out, which column is lowered into the cavity and the brine is caused to move up the column by injecting a gas under pressure. FIG. 2 is a vertical section view through a cavity that is being put under gas using that conventional technique. For such an operation, the bottom end of the column 13 is located close to the bottom of the cavity, immediately above the level reached by the insolubles which have accumulated during the washing-out stage. In this art, the column 13 as lowered in this way is commonly referred to as the "dewatering column". The dewatering column 13 may be constituted by one of the tubes used for washing out, with the end thereof being moved down close to the bottom of the cavity. The gas is injected via the annular space between the cemented casing 11 and the dewatering column 13, and the pressure exerted by the gas causes the brine 5 to rise to the surface inside the dewatering column 13.

That technique nevertheless suffers from certain drawbacks due to the risk of the dewatering column breaking while the cavity is being put under gas and due to the fact that it does not enable brine to be drawn off from below the level reached by the insolubles.

Breakage of the dewatering column is generally the result of unstable blocks of salt or of insolubles falling from the walls of the cavity. This risk increases while the cavity is being put under gas because of the change in the density of the fluid present inside the cavity.

The completion, i.e. the set of well equipment used during the dewatering stage, may optionally include a sub-surface safety device 15 designed to mitigate the risk of gas erupting to the surface in the event of the dewatering column leaking or breaking, or in the event of the well head being damaged.

For a completion without a sub-surface device, the well 1 is fitted with a single tube forming the dewatering column 13 that is lowered to the bottom of the cavity 3 and that is suspended from the well head 10. Under such circumstances, the safety of the operation of putting the cavity under gas relies solely on the surface valves 16 and 17 placed at the well head on the "gas" inlet and on the "brine" outlet. That solution is not without risk. In the event of the dewatering column 13 breaking at a level situated above that of the brine 5 inside the cavity 3, the gas under pressure will rise suddenly via the column 13 and may escape at the surface via the brine discharge line, and that can be very dangerous.

For a completion provided with a sub-surface safety device 15, the inside of the dewatering column 13 is fitted with a "downhole" valve for the purpose of isolating the cavity in the event of gas erupting via the column. To provide against a failure in the operation of the well head 10, a downhole valve may also be installed on the gas injection duct, either in the annular space, or else inside the column by using a flow crossover sleeve. Nevertheless, such safety devices are not always used because they are difficult to make, install, and maintain. In addition, such devices are expensive, both to purchase and to install. The difficulty and the price of implementing such a technique are due to the concentric nature of the cemented casing and the dewatering column.

Another difficulty inherent to implementing the prior art method arises when the dewatering column needs to be raised or lowered in the event of breakage, or merely to be finally withdrawn from the cavity at the end of the dewatering stage. When such operations are performed with a cavity that is filled, at least in part, with gas under pressure, it is necessary to use "snubbing" equipment which makes it possible to maintain well sealing at the surface. The dewatering column is difficult to move since gas erupts whenever the annular space is not properly closed at any time during the operation. Such operations are therefore particularly dangerous and they are also very expensive.

OBJECTS AND SUMMARY OF THE INVENTION

An object of the present invention is to remedy the above drawbacks of the prior art associated with the risk of the dewatering column breaking, by defining a method of putting the cavity under gas that is entirely reliable and that does not require the use of complex safety devices.

In addition, the conventional technique of putting a cavity under gas does not enable the cavity to be emptied of its brine below the top of the level reached by the insolubles. In some cases, the volume lost because of the insolubles can represent a large portion of the total volume created by washing out. This applies when the beds of insolubles are numerous since blocks accumulate at the bottom of the cavity and occupy a large volume because of their swelling. This also applies when blocks of large size become detached from the walls but do not manage to fall all the way down to the bottom, thereby cutting off a large portion of the cavity. Even when a cavity is formed in rock salt that contains few insolubles, the bottom is always occupied by some depth of insolubles which have accumulated therein during washing out.

Another object of the present invention is to solve the above problems of the prior art by providing a method of putting a cavity under gas that enables the cavity to be emptied almost completely of its brine, including brine in that portion of the cavity which occupied by the blocks of insolubles that accumulate in the bottom thereof.

The method comprises drilling an associated dewatering well from the surface in the proximity of the injection well and opening out into the cavity substantially at the bottom thereof. The well that has been used for washing-out purposes and that opens out into the roof of the cavity is used for injecting gas, while the associated or dewatering well is used for raising the brine to the surface while gas is injected into the cavity via the injection well.

The fact of providing an associated well for dewatering eliminates the concentric nature of the tube used for injecting gas and the dewatering column, and it simplifies the installation of well equipment, particularly the installation of sub-surface safety devices. The risk of gas erupting via the brine dewatering column in the event of said column breaking or leaking is eliminated. The dangerous operation of raising the column up a well full of gas under pressure is also avoided.

Also, since there is no longer a dewatering column inside the injection well, the injection well can be fitted out for operation of the storage cavity as soon as the washing-out stage has been completed and there is no longer a difficult operation at the end of putting the cavity under gas during which the dewatering column is raised.

Since there are no longer any complex sub-surface safety devices, and since the flow section in each of the wells can be used to the full, both for injecting gas and for dewatering brine, head losses are minimized and the dewatering flow rate can be much greater than can be obtained in the prior art.

In addition, the method makes it possible to dewater the brine contained in the portion of the cavity that is not accessible via the well which was used for washing it out. Even when the cavity contains a large quantity of insolubles or when a block of large size jams before reaching the bottom, thereby subdividing the cavity into two compartments, it is still possible to dewater the brine occupying the spaces between the blocks of insolubles, so that the cavity can be operated with a maximum useful storage volume. It will be understood that the present method is particularly advantageous to implement when dewatering brine from a cavity formed in rock salt that has a high percentage of insolubles or that is liable to form large blocks that may break away from the walls of the cavity either during washing out or else while the cavity is being put under gas.

Another advantage lies in the fact that the dewatering well can be positioned accurately at the end of the washing-out stage as a function of the real shape of the cavity and as a function of the extent to which it is filled with insolubles.

It is even possible to drill a common dewatering well for a plurality of adjacent cavities, using connections that are made successively from the base of the dewatering well to each of the cavities.

In an implementation of the invention, the dewatering well includes a deep cemented casing going down into the rock salt in which the cavity that is to be put under gas has been developed. It is extended by a non-cased drilling to the bottom of the cavity. Preferably, the drilling is inclined and reaches the cavity laterally at the bottom thereof. The connection between the base of the drilling and the bottom of the cavity may also be obtained by washing out. The dewatering well is fitted with a dewatering column that is lowered to the vicinity of the intersection with the cavity and that is suspended from the well head. The annular space constituted by the well and the dewatering column is filled with a fluid that is inert relative to salt, e.g. with gas oil.

BRIEF DESCRIPTION OF THE DRAWINGS

Other characteristics and advantages of the invention appear in the light of the following detailed description of a non-limiting implementation of the invention described with reference to the accompanying drawings.

In the drawings.

DETAILED DESCRIPTION OF THE PREFERRED EMBODIMENT

Figure 1:
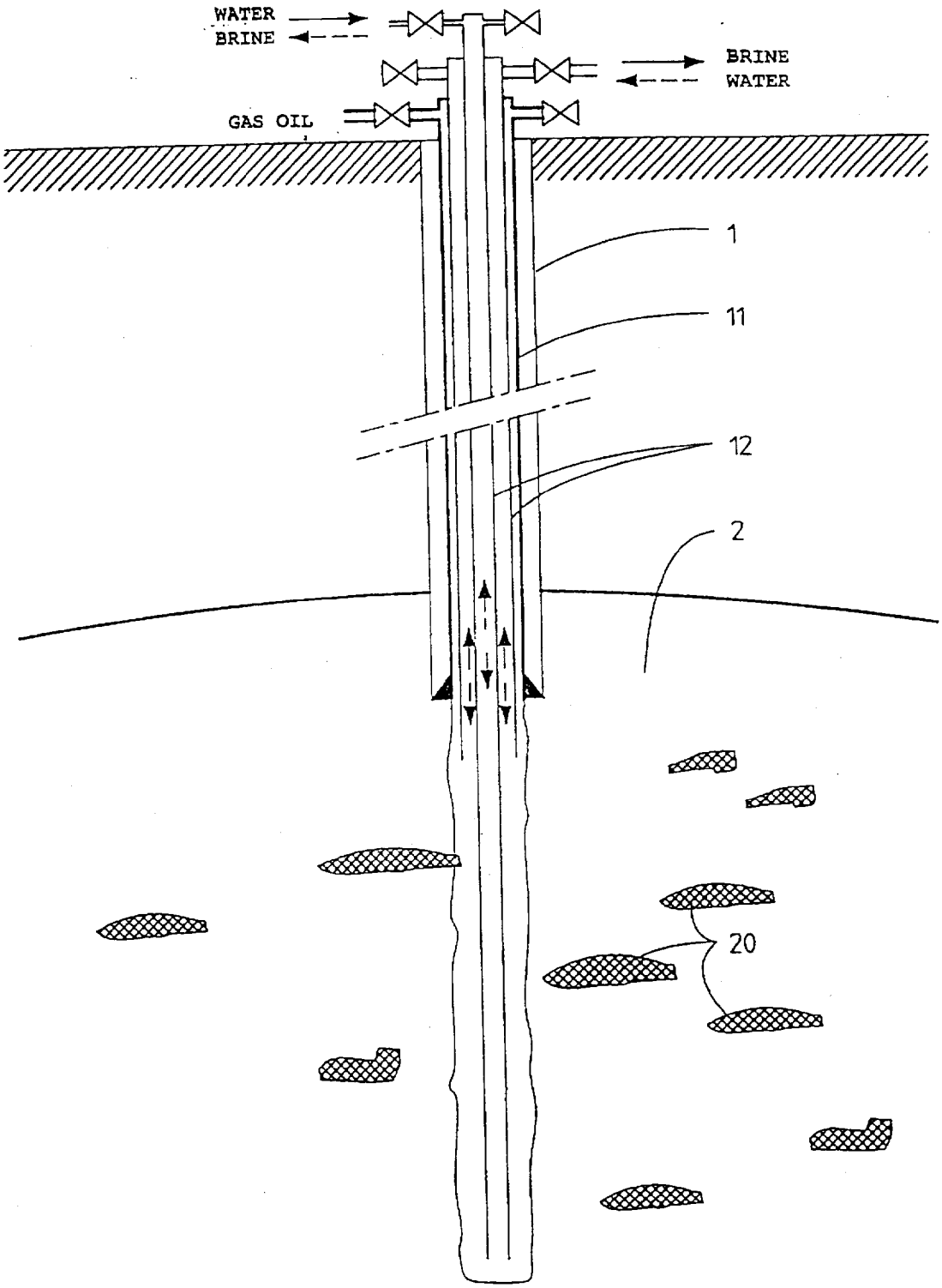
FIG. 1 is a vertical section view through a well drilled into rock salt and fitted for washing out a storage cavity according to the prior art.
Figure 2:
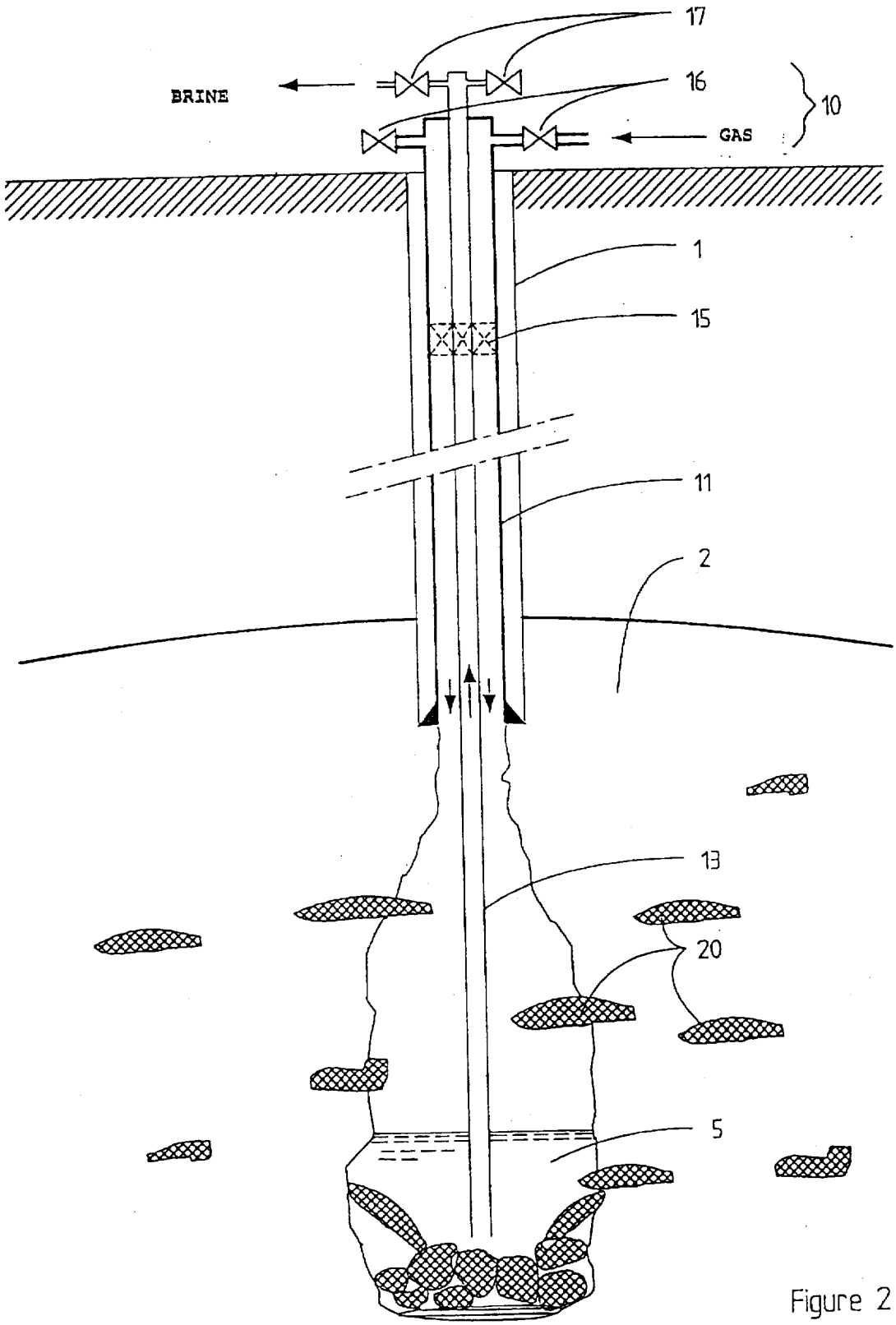
FIG. 2 is a vertical section view of a storage cavity washed out in rock salt, while the cavity is being put under gas by the prior art method.
Figure 3:
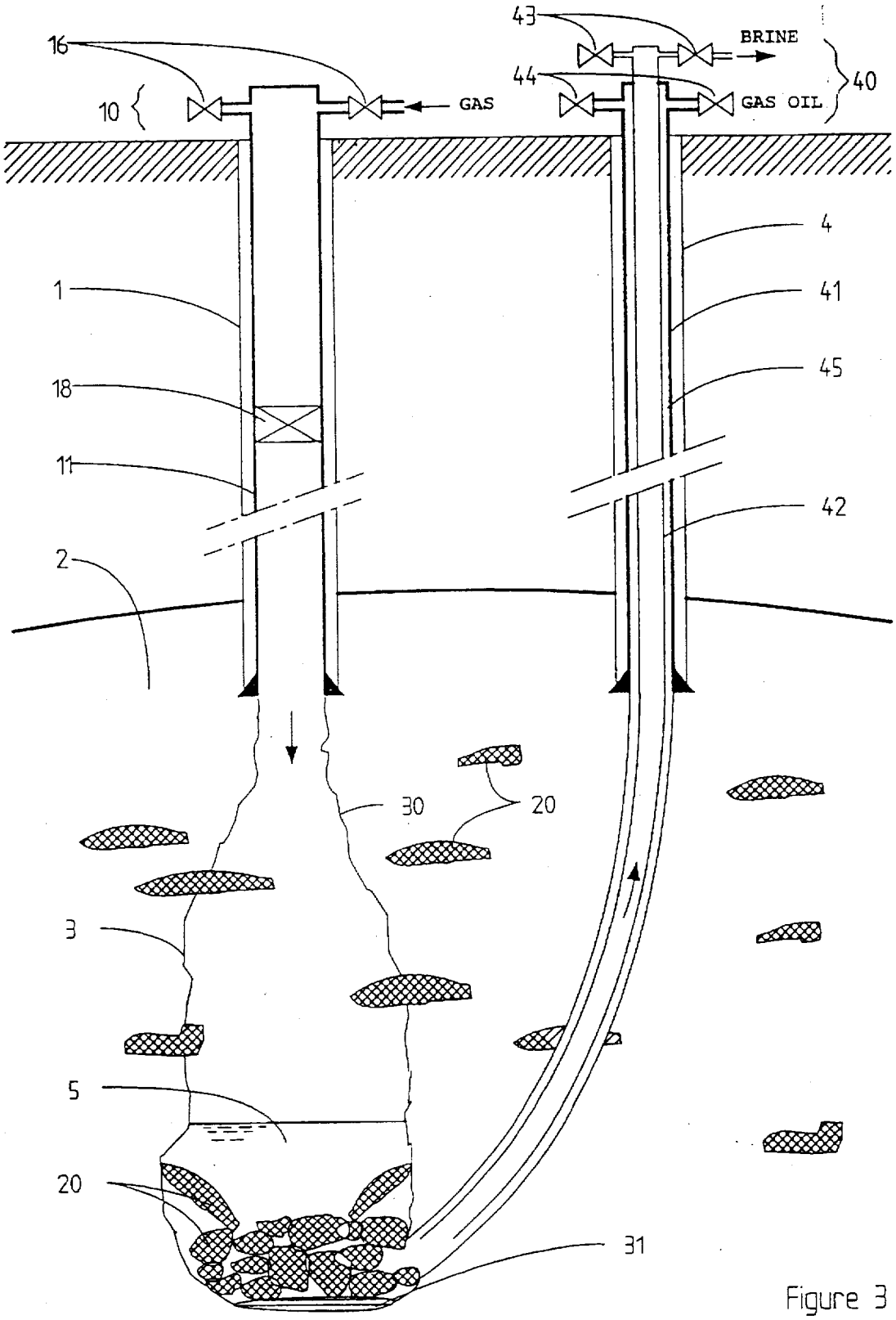
FIG. 3 is a vertical section view through a storage cavity washed out in rock salt while it is being put under gas by the method of the present invention.

As shown in FIG. 3, the brine dewatering installation of the invention comprises, in general, a saline cavity 3 washed out in rock salt 2 and an injection well 1 that has been used for washing-out purposes and that puts the cavity 3 into communication with the surface. The injection well 1 opens out into the cavity 3 through the roof 30 thereof, so that the bottom 31 of the cavity is situated substantially vertically below the injection well 1. The rock salt 2 contains insolubles 20 which, during washing out, have accumulated in the bottom of the cavity in the form of a pile of blocks.

To form the cavity, conventional washing-out techniques have been used. Initially the washing-out well 1 was drilled down to the rock salt 2. Thereafter, the well 1 was fitted with cemented casing 11 covering the wall thereof down to a depth that extends into the salt to be washed out. The casing is installed definitively for the entire lifetime of the storage facility. The well 1 is extended by a vertical drilling that is not cased until it reaches the base of the portion of salt that is to be washed out. Washing-out operations are then performed which consist in causing water to flow over the height that is to be washed out and in raising to the surface the brine which is formed by dissolving the salt. These operations are performed using generally concentric washing-out tubes lowered down the well. Once the cavity has reached its final size, injection of water is stopped. At the end of the washing-out stage, the cavity 3 that has been formed in this way is full of brine which must be extracted in order to release the volume that is going to be used for storage purposes.

The present invention proposes an improved method of putting the cavity under gas, i.e. of injecting a gaseous substance to be stored while simultaneously removing the brine. For this purpose, the invention provides for an associated dewatering well 4 to be drilled from the surface at a certain distance from the washing out and injection well 1, so as to reach the cavity 3 via its bottom 31 or a little above it. The distance on the surface between the two wells 1 and 4 is a function of the shape of the cavity 3 and of the means used for making the dewatering well 4. The dewatering well 4 must be positioned in such a manner as to ensure that it does not intersect the top portion of the cavity 3 while nevertheless ensuring that it does open out close to the bottom 31 of the cavity. AS can be seen in FIG. 3, the dewatering well 4 is deflected so as to have a trajectory enabling it to reach the bottom 31 of the cavity directly. This configuration for the dewatering well requires directed drilling as can be achieved these days by techniques that are thoroughly mastered. It is also possible to make the dewatering well vertically in a position suitable for establishing a connection by washing out between the base of the dewatering well and the bottom of the cavity. The positioning of the dewatering well at the surface, its trajectory, and the location where it opens out into the cavity are preferably determined at the end of the washing-out stage so as to take account of the real shape of the cavity and the extent to which it is filled with insolubles. Under all circumstances, it is advantageous for the bottom end of the dewatering well 4 to open out as close as possible to the bottom 31. This makes it possible to remove nearly all of the brine 5 contained in the cavity and to obtain as large as possible a volume that can be used for storage purposes. The brine can be removed only down to the level where the dewatering well 4 intersects the cavity 3. A minimum depth of brine must be maintained above this level so as to prevent any risk of the gas erupting via the dewatering well 4.

In the disposition of the installation provided by the present method of removing the brine, there is no dewatering column placed inside the gas injection well 1, thereby simplifying completion of the well and reducing the technical difficulties encountered in the prior art.

The well 1 that has been used for washing out and that is being used for gas injection is completed for the purpose of using the storage facility. Thus, as soon as the washing-out stage has been completed, the operating equipment can be fitted to the injection well, thereby contributing to improving the safety of the operation of putting the cavity under gas. The type of completion used for this well is similar to that used for other underground gas storage facilities or for production purposes in gas fields. In FIG. 3, the well 1 is fitted with cemented casing 11 that is installed before washing out begins and in which a downhole safety valve 18 is installed. The valve 18 does not require special technology, unlike the valve that is required to obtain the same degree of safety when using the prior art method of removing the brine. Completion of the injection well 1 may optionally include production tubing (not shown in FIG. 3) for protecting the cemented casing 11. At the surface, the well head 10 is fitted with valves 16 for closing and opening the injection well 1. While the storage facility is in operation, the well 1 is used for injecting and for drawing off gas.

The dewatering well 4 is also fitted with cemented casing 41 which goes down into the rock salt 2, as shown in FIG. 3. It is preferable for the bottom portion of the dewatering well 4 not to be cased in cemented casing so as to make it easier to close the well off once the brine has been removed. When the cavity is being put under gas, the dewatering well 4 is fitted with a dewatering column 42 that is lowered down to a depth that is close to the level of intersection with the cavity 3. At the surface, this column 42 is suspended from a well head 40 that is fitted with valves 43 and 44 enabling the inside of the dewatering column 42 to be closed and also enabling the annular space 45 between the wall of the well 4 and the column 42 to be closed. Advantageously, this annular space is filled with a fluid that is inert relative to salt, e.g. gas oil. The presence of a dewatering column 42 inside the well 4 facilitates taking actions that could be necessary, e.g. in the event of clogging due to the salt crystallizing as the brine 5 is rising towards the surface, and it enables fresh water to be injected periodically. The annular space is filled with gas oil or with some other fluid that is inert relative to salt, so as to prevent the wall of the bottom portion of the well 4 dissolving and also so as to prevent crystallization of salt which could have the effect of jamming the column 42.

While the cavity is being put under gas and the brine 5 is being dewatered therefrom, the installation is in the configuration shown in FIG. 3. Gas is injected under pressure into the cavity 3 via the injection well 1, thereby causing the brine 5 to rise to the surface via the column 42 placed inside the dewatering well 4. Gas injection is continued until the level of brine 5 in the cavity 3 comes to just above the bottom end of the dewatering well 4, and the brine 5 that then remains inside the cavity 3 cannot be extracted. At the end of the stage during which the cavity is put under gas, the gas oil or other fluid present in the annular space is recovered, the dewatering column 42 is raised to the surface, and the dewatering well 4 is obstructed by a cement plug over its entire portion that is not cased by the cemented casing 41, thereby avoiding any risk of gas leaking during operation. It should be observed that the dewatering column 42 can be withdrawn without it being necessary to implement special techniques as a precaution against gas erupting. For this purpose, it suffices to reduce the pressure of the gas within the cavity to a value corresponding to the hydrostatic pressure of the brine column extending between the surface and the level of the gas/brine interface within the cavity, with the brine then acting as a kind of hydraulic plug isolating the gas contained in the cavity from the dewatering well. Better safety is thus obtained during extraction of the dewatering column by using means that are very simple. the present technique therefore provides both an improvement and a simplification when raising the dewatering column at the end of the operation of putting the cavity under gas.

The above-described technique for putting a cavity under gas is particularly advantageous for use on sites where the rock salt has a high percentage of insolubles, and in particular sites where the insolubles appear in the form of beds of greater or lesser thickness. If such insolubles do not drop to the bottom of the cavity during the washing-out stage, then they constitute projections that are often unstable. While the cavity is being put under gas, the buoyancy thrust exerted on these blocks suddenly decreases, so risks of instability are greatly increased. In the best of cases, the blocks which break off collect in the bottom of the cavity. However it can happen that the blocks obstruct the cavity at much higher levels, thereby subdividing the cavity into a plurality of compartments. The greater the number and thickness of the beds of insolubles, and the smaller the diameter of the cavity, the greater the risk of it becoming jammed thereby. This situation may also arise in rock salt that has few insolubles but which has an aptitude for being washed out such that washing out produces a cavity of irregular shape in which blocks of salt break off from the walls and collect in the bottom of the cavity without dissolving. In the prior art, a large-sized block falling while the cavity was being put under gas generally had the consequence of damaging or even breaking the dewatering column. Difficult and expensive operations were then necessary to put the installation back into condition and to proceed with putting it under gas. In addition, if a cavity is obstructed during washing out or while it is being put under gas by a block that has not managed to fall all the way down to the bottom, brine cannot be dewatered from beneath the obstruction, so a large portion of the volume of the cavity can be lost.

By using the technique of the present invention, any risk of the dewatering column being broken by a falling block is eliminated. In addition, the positioning of the end of the dewatering well at the bottom of the cavity makes it possible to empty a maximum amount of brine therefrom and thus to make best possible use of the volume of the cavity as a storage volume. Even in the event of falling blocks making obstructions, the brine can be dewatered in optimum manner. As a result the present invention makes it possible to establish storage installations in rock salt sites that have a large content of insolubles, which is not possible using the prior art technique.

I claim:

1. A method of storing a gaseous substance in a saline cavity, the cavity being formed by washing out rock salt and being filled with brine once the washing out has been completed, said cavity including a bottom (31) and a roof (30), a first well (1) drilled for the washing out opening out in the roof and communicating said saline cavity with the surface, said well also serving as an injection well for the gaseous substance to be stored, the method including the steps of:

drilling a second, associated dewatering well (4) from the surface in proximity to said injection well, the dewatering well meeting said saline cavity close to the bottom thereof, and injecting the gaseous substance into the cavity via the injection well to attendantly and simultaneously displace the brine out from the cavity through said dewatering well.

2. A method according to claim 1, including providing a deep cemented casing in the dewatering well, extending down into the rock salt.

3. A method according to claim 1, including providing a non-cased section in the dewatering well, which opens into a side of the cavity close to the bottom thereof.

4. A method according to claim 1, including connecting the dewatering well to the bottom of the cavity by washing out rock salt between said cavity bottom and a bottom of the dewatering well.

5. A method according to claim 1, including lowering a dewatering column in the dewatering well substantially to a vicinity of the bottom of the cavity to define an annular space with a wall of the dewatering well.

6. A method according to claim 5, including filling the annular space including filling the annular space with a fluid that is inert relative to salt.

7. A method according to claim 1, including displacing brine from the bottom of the cavity surrounding insolubles or blocks of salt accumulated therein during the washing out, said dewatering well opening into the bottom of the cavity at a level lower than a level of the accumulated insolubles or blocks of salt.

* * * * *